US005428183A

United States Patent [19]

Matsuda et al.

[11] Patent Number: 5,428,183

[45] Date of Patent: Jun. 27, 1995

[54] TONE SIGNAL GENERATING APPARATUS FOR PERFORMING A TIMBRE CHANGE BY STORING A FULL FREQUENCY BAND IN A WAVE MEMORY

[75] Inventors: Eiji Matsuda, Shizuoka; Hiroshi Kitagawa, Iwata; Gen Izumisawa; Jiro Tanaka, both of Hamamatsu, all of Japan

[73] Assignee: Kabushiki Kaisha Kawai Gakki Seisakusho, Shizuoka, Japan

[21] Appl. No.: 168,191

[22] Filed: Dec. 17, 1993

[30] Foreign Application Priority Data

Dec. 24, 1992 [JP] Japan ..... 4-357325

[51] Int. Cl.[6] ..... G10H 1/12; G10H 7/02

[52] U.S. Cl. ..... 84/604; 84/622; 84/661; 84/DIG. 9

[58] Field of Search ..... 84/662–625, 84/604–608, DIG. 9, 661, 699, 700, 736

[56] References Cited

U.S. PATENT DOCUMENTS 4,679,480 7/1987 Suzuki ..... 84/DIG. 9

*Primary Examiner*—Stanley J. Witkowski

*Attorney, Agent, or Firm*—Birch, Stewart, Kolasch & Birch

[57] ABSTRACT

A tone signal generating apparatus, including a memory for storing wave data containing frequency components within a full band; a tone generator for reading the wave data from the memory in accordance with key ON/OFF data to generate a tone signal; a velocity generator for generating a velocity value based on key ON/OFF data; a first coefficient processor for producing a first coefficient to control the amplitude in accordance with the velocity value generated by the velocity generator; a first operator for performing an operation on the first coefficient produced by the first coefficient processor and the tone signal generated by the tone generator, a filter for extracting frequency components within a specific band from the tone signal output from the first operator to produce a first tone signal and outputting the first tone signal; a second coefficient processor for producing a second coefficient to control the amplitude in accordance with the velocity value generated by the velocity generator; and a second operator for performing an operation on the second coefficient produced by the second coefficient processor and the tone signal produced by the tone generator to obtain a second tone signal and outputting the second tone signal.

14 Claims, 9 Drawing Sheets

TONE SIGNAL GENERATING APPARATUS FOR PERFORMING A TIMBRE CHANGE BY STORING A FULL FREQUENCY BAND IN A WAVE MEMORY

BACKGROUND OF THE INVENTION

The present invention relates to a tone signal generating apparatus adapted for use in an electronic musical instrument, and more particularly, to a tone signal generating apparatus for generating a tone signal to change timbre in accordance with a key touch.

DESCRIPTION OF THE RELATED ART

Recently, an electronic musical instrument, such as a synthesizer, an electronic piano, an electronic organ, a single keyboard and a tone generator module, has been developed and become popular. In such an electronic musical instrument, tone data produced by operating a keyboard or a control panel, for example, is supplied to a tone signal generating apparatus provided in the instrument. MIDI data externally supplied is also supplied to the tone signal generating apparatus. The tone signal generating apparatus generates a tone signal according to the received tone data or MIDI data. The tone signal generated from the tone signal generating apparatus is converted to an acoustic signal through a loudspeaker to produced a musical tone.

It is known that in a natural musical instrument like an acoustic piano, the timbres of tones even with the same pitch vary slightly with different key touches. Generally, in an electronic musical instrument, the difference in key touch is detected as a difference in key depression speed, which is reflected on the strength of a tone. There is also an electronic musical instrument developed which is designed to change the timbre in accordance with the key touch to imitate the characteristics of the natural musical instruments.

In the conventional electronic musical instrument which has a function to change the timbre in accordance with the key touch, the difference in key touch is reflected not only as a difference in the strength of a tone but also as a difference in timbre. The tone signal generating apparatus used in the conventional electronic musical instrument includes a wave data generator as shown in, diagram in FIG. 8 for example.

In FIG. 8, a wave memory 80 is used to store wave data containing low-frequency components. The wave data stored in this wave memory 80 is prepared by, for example, converting a generated musical sound to an electrical signal and then putting this signal through a low-pass filter. The data stored in the wave memory 80 is sequentially read out in response to instructions from a central processing unit (CPU), which is not shown. The read-out wave data is supplied to a volume controller 83. Likewise, a wave memory 81 is used to store wave data containing high-frequency components. The wave data stored in the wave memory 81 is prepared by, for example, converting a generated musical sound to an electrical signal and then putting this signal through a high-pass filter. The wave data read out from the wave memory 81 is supplied to another volume controller 84.

A touch detector 82 detects the key depression speed based on data indicating the ON/OFF status of a key which is output from a keyboard (not shown), or based on MIDI data externally supplied. The touch detector 82 also generates a coefficient V1 having such a characteristic (first characteristic) that its value decreases as the key depression speed increases and a coefficient V2 having such a characteristic (second characteristic) that its value increases as the key depression speed increases, as shown in FIG. 9. The coefficient V1 generated by the touch detector 82 is supplied to the volume controller 83, while the coefficient V2 generated is supplied to the volume controller 84.

The volume controller 83 performs an operation (e.g., multiplication) on the wave data from the wave memory 80 and the coefficient V1 from the touch detector 82, and sends out the result to an adder 85. Likewise, the volume controller 84 performs an operation (e.g., multiplication) on the wave data from the wave memory 81 and the coefficient V2 from the touch detector 82 and sends out the result to the adder 85.

The adder 85 adds the operational result, wave data, from the volume controller 83 and the operational result, wave data, from the volume controller 84 together to yield mixed wave data. Accordingly, the adder 85 outputs wave data OUT which has low-frequency components and high-frequency components properly mixed in accordance with the key depression speed. In other words, the wave data OUT which is output from this wave data generator contains a smaller amount of high-frequency components and a larger amount of low-frequency components as the key depression speed gets lower. As the key depression speed becomes faster, the wave data OUT contains a smaller amount of low-frequency components and a larger amount of high-frequency components.

The tone signal generating apparatus produces a tone signal which is the wave data OUT with a predetermined envelope affixed thereto. The electronic musical instrument generates a musical tone based on this tone signal. In short, the conventional tone signal generating apparatus generates a tone signal in which the mixing ratio of low-frequency components to high-frequency components is controlled in accordance with the key depression speed. This can accomplish a timbre change according to the key touch. Accordingly, the electronic musical instrument using such an apparatus can generate musical tones similar to those of a natural musical instrument.

The above-described conventional structure however requires plural types of wave data prepared in advance to realize the timbre change, thus requiring a large-capacity wave memory. To read out plural types of wave data from the wave memory, a plurality of circuits for reading-out are needed, which increases the amount of hardware for reading out wave data. This disadvantageously increases the manufacturing cost of the tone signal generating apparatus.

OBJECTS AND SUMMARY OF THE INVENTION

It is therefore an object of the present invention to provide an inexpensive tone signal generating apparatus which will achieve a timbre change in accordance with a key touch with fewer wave memories and a smaller amount of hardware.

To achieve the above object, according to a first embodiment of the present invention, there is provided a tone signal generating apparatus, which comprises memory means for storing wave data containing frequency components within a full band; a tone generator for reading out the wave data from the memory means in accordance with key ON/OFF data and generating a tone signal based on the wave data; velocity value generating means for generating a velocity value based on the key ON/OFF data; first coefficient processing means for obtaining a first coefficient according to the velocity value generated by the velocity value generating means; first operation means for performing an operation on the first coefficient obtained by the first coefficient processing means and the tone signal generated by the tone generator and producing a tone signal based on an operation result; filtering means for extracting frequency components within a specific band from the tone signal output from the first operation means, producing a first tone signal based on an extraction result, and outputting the first tone signal; second coefficient processing means for obtaining a second coefficient according to the velocity value generated by the velocity value generating means; and second operation means for performing an operation on the second coefficient obtained by the second coefficient processing means and the tone signal generated by the tone generator, producing a second tone signal based on an operation result, and outputting the second tone signal.

In the tone signal generating apparatus according to the first embodiment, wave data containing frequency components within a full band is stored in advance in the memory means. When receiving the key ON/OFF data, the tone generator sequentially reads out the wave data from the memory means to generate a tone signal. The tone signal generated by the tone generator contains frequency components within a full band. This tone signal is supplied to the first operation means and the second operation means. The velocity value generating means generates a velocity value based on the key ON/OFF data. This velocity value is supplied to the first coefficient processing means and the second coefficient processing means.

The first coefficient processing means produces a first coefficient according to the velocity value. The first coefficient is supplied to the first operation means. The first operation means performs an operation on the received first coefficient and the tone signal supplied from the tone generator. The resulting tone signal from the first operation means is supplied to the filtering means. The filtering means extracts frequency components within a specific band from the received tone signal and outputs the resultant tone signal. The tone signal from the filtering means is output as a first tone signal out side of this tone signal generating apparatus.

The second coefficient processing means produces a second coefficient according to the received velocity value. This second coefficient is supplied to the second operation means. The second operation means performs an operation on the received second coefficient and the tone signal supplied from the tone generator. The resultant tone signal from the second operation means is output as a second tone signal out side of this tone signal generating apparatus.

When the first tone signal and second tone signal produced by the tone signal generating apparatus in the above manner are sounded through loudspeakers, the tone containing frequency components within a full band and the tone containing frequency components within a specific band are mixed in accordance with the velocity value in the sounded state. Accordingly, it is possible to accomplish a function to change the timbre according to the key touch.

In the tone signal generating apparatus according to the first embodiment, it is preferable that the first coefficient processing means be designed to generate a first coefficient whose value becomes smaller as the velocity value increases, and the second coefficient processing means be designed to generate a second coefficient whose value becomes larger as the velocity value increases, as indicated by, for example, a first characteristic line V1 and a second characteristic line V2 in FIG. 9. With those structures, as the key depression speed gets slower, the mixing ratio of frequency components within a specific band to frequency components within the full band decreases. As the key depression speed becomes faster, on the other hand, the mixing ratio of frequency components within the specific band to frequency components within the full band increases. In this manner, the mixing ratio of frequency components within a specific band to frequency components within the full band changes in accordance with the key depression speed. As a result, a timbre change according to the key touch can be accomplished, thus ensuring the generation of tones close to those of a natural musical instrument.

In the tone signal generating apparatus according to the first embodiment, it is further preferable that the first operation means be constituted of a multiplier. The second operation means may also be constituted of a multiplier. With those structures, it is possible to alter the tone signal generated by the tone generator to that tone signal which has a level according to the first coefficient or the second coefficient. Accordingly, the mixing ratio of frequency components within a specific band to frequency components within the full band can be changed in accordance with the key depression speed.

In the tone signal generating apparatus according to the first embodiment, it is also preferable that the filtering means be constituted of a low-pass filter. In this case, frequency components within a specific band are low-frequency components. Therefore, as the key depression speed gets slower, the mixing ratio of low-frequency components to frequency components within the full band decreases. As the key depression speed becomes faster, on the other hand, the mixing ratio of low-frequency components to frequency components within the full band increases. In this manner, a timbre change according to the key touch can be accomplished by controlling the mixing ratio of low-frequency components to frequency components within the full band in accordance with the key depression speed, thus ensuring the generation of tones close to those of a natural musical instrument.

In the tone signal generating apparatus according to the first embodiment, it is still preferable that the apparatus should further include mixing means for mixing the first tone signal output from the filtering means with the second tone signal output from the second operation means and outputting a resultant signal. This mixing means may be constituted of an adder. The output of the mixing means is a tone signal in which the mixing ratio of low-frequency components to frequency components within the full band is controlled in accordance with the key depression speed. It is therefore possible to generate a musical tone whose timbre varies in accordance with the key touch.

According to a second embodiment of the present invention, there is provided a tone signal generating apparatus which comprises memory means for storing wave data containing frequency components within a full band; a tone generator for reading out the wave data from the memory means in accordance with key ON/OFF data and generating a tone signal based on the wave data; filtering means for extracting frequency components within a specific band from the tone signal generated by the tone generator, producing a tone signal based on an extraction result, and outputting the tone signal; velocity value generating means for generating a velocity value based on the key ON/OFF data; first coefficient processing means for obtaining a first coefficient according to the velocity value generated by the velocity value generating means; first operation means for performing an operation on the first coefficient obtained by the first coefficient processing means and the tone signal output from the filtering means, producing a first tone signal based on an operation result, and outputting the first tone signal; second coefficient processing means for obtaining a second coefficient according to the velocity value generated by the velocity value generating means; and second operation means for performing an operation on the second coefficient obtained by the second coefficient processing means and the tone signal generated by the tone generator, producing a second tone signal based on an operation result, and outputting the second tone signal.

In the tone signal generating apparatus according to the second embodiment, wave data containing frequency components within a full band is stored in advance in the memory means. When receiving key ON/-OFF data, the tone generator sequentially reads out the wave data from the memory means to generate a tone signal. The tone signal generated by the tone generator contains frequency components within a full band. This tone signal is supplied to the filtering means and second operation means. The filtering means extracts frequency components within a specific band from the received tone signal. The tone signal output from this filtering means is supplied to the first operation means. The velocity value generating means generates a velocity value based on the key ON/OFF data. This velocity value is supplied to the first coefficient processing means and second coefficient processing means.

The first coefficient processing means produces a first coefficient according to the velocity value. The first coefficient is supplied to the first operation means. The first operation means performs an operation on the received first coefficient and the tone signal supplied from the filtering means. The resulting tone signal from the first operation means is output as a first tone signal outside of this tone signal generating apparatus.

The second coefficient processing means produces a second coefficient according to the received velocity value. This second coefficient is supplied to the second operation means. The second operation means performs an operation on the received second coefficient and the tone signal from the tone generator. The resultant tone signal supplied from the second operation means is output as a second tone signal outside of this tone signal generating apparatus.

When the first tone signal and second tone signal produced by the tone signal generating apparatus in the above manner are sounded through loudspeakers, the tone containing frequency components within a full band and the tone containing frequency components within a specific band in the sounded state are mixed in accordance with the velocity value. Accordingly, it is possible to accomplish a function to change the timbre according to the key touch.

In the tone signal generating apparatus according to the second embodiment, it is preferable that the first coefficient processing means be designed to generate a first coefficient whose value becomes smaller as the velocity value increases, and the second coefficient processing means be designed to generate a second coefficient whose value becomes larger as the velocity value increases, as indicated by, for example, a first characteristic line V1 and a second characteristic line V2 in FIG. 9. With those structures, as the key depression speed gets slower, the mixing ratio of frequency components within a specific band decreases and the mixing ratio of frequency components within the full band increases. As the key depression speed becomes faster, on the other hand, the mixing ratio of frequency components within the full band decreases and the mixing ratio of frequency components within the specific band increases. In this manner, the mixing ratio of frequency components within a specific band to frequency components within the full band changes in accordance with the key depression speed. As a result, a timbre change according to the key touch can be accomplished, thus ensuring the generation of tones close to those of a natural musical instrument.

In the tone signal generating apparatus according to the second embodiment, it is further preferable that the first operation means be constituted of a multiplier. The second operation means may also be constituted of a multiplier. With this structure, it is possible to alter the tone signal generated by the tone generator to that tone signal which has a level according to the first coefficient or the second coefficient. Accordingly, the mixing ratio of frequency components within a specific band to frequency components within the full band can be changed in accordance with the key depression speed.

In the tone signal generating apparatus according to the second embodiment, it is also preferable that the filtering means be constituted of a low-pass filter. In this case, frequency components within a specific band are low-frequency components. Therefore, as the key depression speed gets slower, the mixing ratio of low-frequency components decreases and the mixing ratio of frequency components within the full band increases. As the key depression speed becomes faster, on the other hand, the mixing ratio of frequency components within the full band decreases and the mixing ratio of low-frequency components increases. In this manner, a timbre change according to the key touch can be accomplished by controlling the mixing ratio of low-frequency components to frequency components within the full band in accordance with the key depression speed, thus ensuring the generation of tones close to those of a natural musical instrument.

In the tone signal generating apparatus according to the second embodiment, it is still preferable that the apparatus should further include mixing means for mixing the first tone signal output from the first operation means with the second tone signal output from the second operation means and outputting a resultant signal. This mixing means may be constituted of an adder. The output of the mixing means is a tone signal in which the mixing ratio of low-frequency components to frequency components within the full band is controlled in accordance with the key depression speed. It is therefore possible to generate a musical tone whose timbre varies in accordance with the key touch.

DETAILED DESCRIPTION OF THE PREFERRED EMBODIMENTS

Tone signal generating apparatuses according to the embodiments of the present invention will now be described in detail referring to the accompanying drawings. The following description will be centered on the structure and operation for accomplishing a function to change the timbre in accordance with the key touch.

First Embodiment

Figure 1:
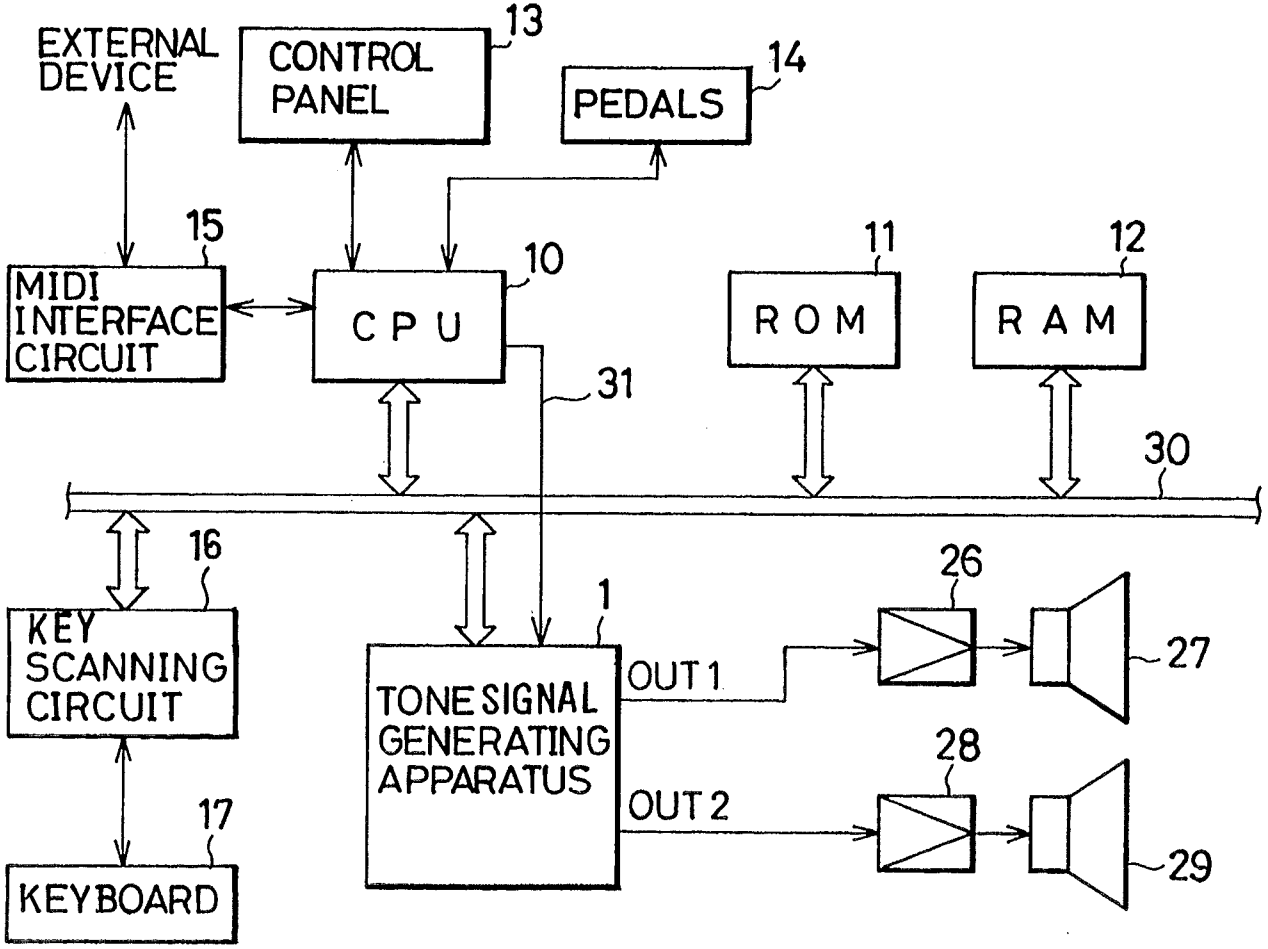
FIG. 1 is a block diagram illustrating the structure of an electronic musical instrument to which a tone signal generating apparatus according to the present invention is adapted.

FIG. 1 is a block diagram showing the schematic structure of an electronic musical instrument to which a tone signal generating apparatus 1 according to the first embodiment is adapted.

The electronic musical instrument comprises a CPU 10, a read only memory (ROM) 11, a random access memory (RAM) 12, a key scanning circuit 16 and a tone signal generating apparatus 1, which are mutually connected by a system bus 30. The system bus 30 includes an address bus, a data bus and a control signal bus, for example.

The CPU 10 performs general control of the electronic musical instrument according to a control program stored in the ROM 16. For instance, in accordance with the depression of a key on a keyboard 17 or the reception of MIDI data at a MIDI interface circuit 15, the CPU 10 executes a velocity detecting process, a coefficient generating process, a process for assigning a tone-generating channel, a process for accessing the tone signal generating apparatus 1, or other associated processes.

A control panel 13, pedals 14 and the MIDI interface circuit 15 are further connected to the CPU 10 via exclusive lines. The tone signal generating apparatus 1 is also connected to the CPU 10 via an exclusive line 31. The CPU 10 also performs a part of the function of the tone signal generating apparatus 1. The details of those circuits will be discussed later.

The ROM 11 holds various kinds of fixed data that the CPU 10 uses in various processes in addition to the control program for functioning the CPU 10. Further stored in the ROM 11 is a table for realizing predetermined functions with velocity values taken as variables. This table includes a first table on which a function value (first coefficient V1) for providing the first characteristic is stored and a second table on which a function value (second coefficient V2) for providing the second characteristic is stored.

The memory contents of the ROM 11 are read out via the system bus 30 by the CPU 10. That is, the CPU 10 fetches the control program (instruction) from the ROM 11 via the system bus 30, and decodes and executes it, or reads out predetermined fixed data from the ROM 11 and uses it in an operation. Further, the CPU 10 refers to the aforementioned tables to read out the first coefficient V1 or the second coefficient V2, and sends the coefficient to the tone signal generating apparatus 1 (to be described later) via the exclusive line 31.

The RAM 12 temporarily stores various kinds of data necessary to run the control program, and has areas, such as data buffers, registers and flags, defined therein. Various kinds of data supplied from the control panel 13, pedals 14, keyboard 17, etc., which will be described later, are also temporarily stored in the RAM 12. The CPU 10 accesses the RAM 12 via the system bus 30.

The control panel 13 connected to the CPU 10 comprises switches for indicating various kinds of operations to the electronic musical instrument, a numeral inputting device for inputting parameters to be set in the electronic musical instrument, and a display for displaying predetermined information; none of the components of the control panel 13 are shown.

The switches include a timbre change switch for changing the timbre, a volume switch for changing the volume, and an effect switch for providing various types of sound effects. The numeral inputting device is used to input various kinds of parameters to be set in the electronic musical instrument, in numerals, and may be accomplished by a dial or ten keys. The display is used to display various messages or the status of the electronic musical instrument under the control of the CPU 10, and may be constituted of an LCD.

The control panel 13 is connected to the CPU 10 via a panel scanning circuit (not shown). The panel scanning circuit scans the individual switches and the numeral inputting device of the control panel 13, and sends the ON/OFF status of each switch and the set status of the numeral inputting device as panel data to the CPU 10. This panel data is stored in the RAM 12 and is used to determine the presence or absence of a panel event in a panel event process (to be described later) under the control of the CPU 10.

The pedals 14 connected to the CPU 10 include foot pedals for providing various kinds of sound effects, such as a damper pedal, a soft pedal and a sostenuto pedal.

The pedals 14 are connected to the CPU 10 via a pedal scanning circuit (not shown). The pedal scanning circuit scans the individual pedals and sends pedal data representing the ON/OFF status of each pedal to the CPU 10. This pedal data obtained by the scanning of the pedal scanning circuit is stored in the RAM 12 and is used to determine the presence or absence of a pedal event in a pedal event process (to be described later) under the control of the CPU 10.

The MIDI interface circuit 15 connected to the CPU 10 serves to control the exchange of MIDI data between the electronic musical instrument and an external device. The external device may be a personal computer, a sequencer or another electronic musical instrument designed to be able to process MIDI data. The MIDI interface circuit 15 interrupts the CPU 10 to exchange data with the CPU 10. The external device transfers MIDI data indicating the ON/OFF status of a key and other various operations to the CPU 10 through the MIDI interface circuit 15. The MIDI data indicating the key ON/OFF status is used to determine the presence or absence of a key event or to detect a velocity (the details will be given later).

The keyboard 17 has a plurality of keys for allowing a player to specify intervals, and has a plurality of key switches which are interlocked with the associated keys to be opened or closed. Two key switches are provided for each key, so that the key depression speed (velocity) can be detected by measuring the time from the point at which the first key switch is set on to the point at which the second switch is set on. The keyboard 17 is connected to a key scanning circuit 16.

The key scanning circuit 16 scans the individual key switches of the keyboard 17 and outputs data indicating the status of each key switch by one bit (hereinafter called "key data"). "1" or "0" of each bit of the key data corresponds to the ON or OFF status of each key. This key data is supplied via the system bus 30 to the CPU 10. The key data is stored in the RAM 12 and is used to determine the presence or absence of a key event and to detect the velocity under the control of the CPU 10 (the details will be given later).

The tone signal generating apparatus 1 produces analog tone signals of two systems, i.e., a first tone signal OUT1 and a second tone signal OUT2, in response to an instruction from the CPU 10. To perform the function of the tone signal generating apparatus 1, a part of the function of the CPU 10 is used. The details of the tone signal generating apparatus 1 will be given later.

The first tone signal OUT1 and the second tone signal OUT2 are supplied to amplifiers 26 and 28.

The amplifiers 26 and 28 are each of a known type, each of which amplifies an input analog tone signal with a predetermined amplification factor and outputs the amplified tone signal. The analog tone signal subjected to a predetermined amplification in the amplifier 26 is supplied to a loudspeaker 27 while the analog tone signal subjected to a predetermined amplification in the amplifier 28 is supplied to a loudspeaker 29.

The loudspeakers 27 and 29 are each of a known type which converts an analog tone signal as an electrical signal to an acoustic signal. Through the loudspeakers 27 and 29, musical tones according to the depression of keys on the keyboard 17 or the MIDI data supplied from the MIDI interface circuit 15 are sounded.

Figure 2:
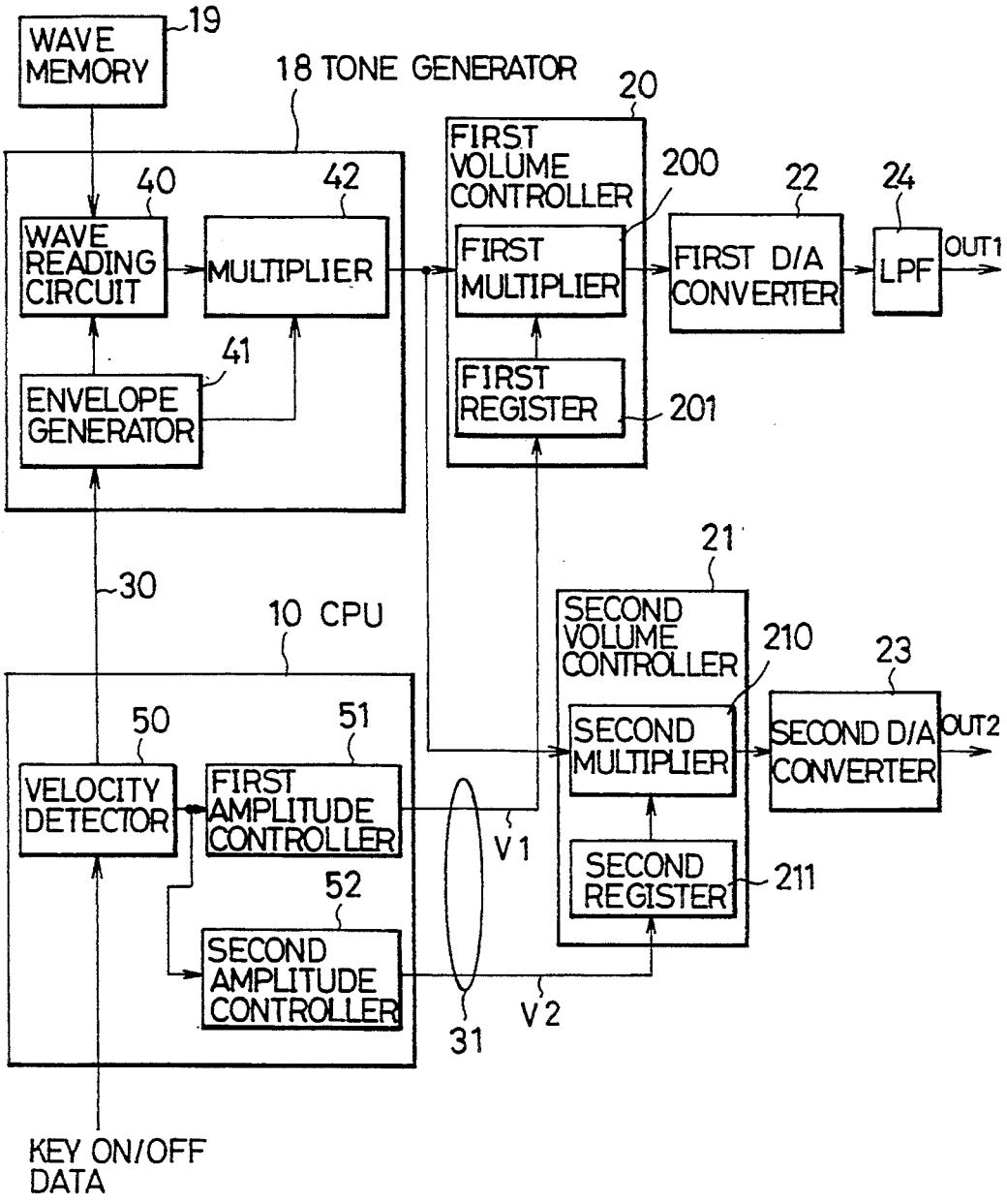
FIG. 2 is a block diagram showing the structure of a tone signal generating apparatus according to a first embodiment of the present invention.

FIG. 2 is a block diagram showing the detailed structure of the tone signal generating apparatus according to the first embodiment. This tone signal generating apparatus of the first embodiment comprises a tone generator 18, a wave memory 19, a first volume controller 20, a second volume controller 21, a first D/A converter 22, a second D/A converter 23, a low-pass filter (LPF) 24 and a part of the CPU 10.

The tone generator 18 has 32 oscillators, for example. The individual oscillators of the tone generator 18 are driven in accordance with data given from the CPU 10. Each driven oscillator produces a digital tone signal in a time divisional fashion and sends the digital tone signal to the first volume controller 20 and the second volume controller 21.

The tone generator 18 comprises a wave reading circuit 40, an envelope generator 41 and a multiplier 42. The wave reading circuit 40 reads out wave data from a predetermined location in the wave memory 19 specified by a wave address supplied from the CPU 10 at a speed corresponding to frequency data also supplied from the CPU 10. The wave data read out by this wave reading circuit 40 is supplied to the multiplier 42.

The envelope generator 41 processes envelope data predetermined for each timbre in accordance with the velocity value from a velocity detector 50 (to be described later) to produce an envelope signal. This envelope signal is supplied to the multiplier 42. To synchronize the wave data read out by the wave reading circuit 40 with the envelope signal produced by the envelope generator 41, the envelope generator 41 supplies a synchronizing signal to the wave reading circuit 40.

The multiplier 42 multiplies the wave data read out by the wave reading circuit 40 by the envelope signal produced by the envelope generator 41. As a result, the multiplier 42 outputs an envelope-added digital tone signal. This output of the multiplier 42 is supplied to a first multiplier 200 in the first volume controller 20 and a second multiplier 210 in the second volume controller 21.

The wave memory 19 is constituted of a ROM, for example. Stored in the wave memory 19 is wave data, which is obtained by converting the tones generated by, for example, an acoustic musical instrument, directly to an electrical signal and then subjecting the electrical signal to pulse code modulation (PCM). Therefore, the wave data stored in the wave memory 19 contains frequency components within a full band, that is, a fundamental tone and overtones of a plurality of orders. The wave memory 19 stores plural types of wave data corresponding to individual timbres to provide plural kinds of timbres. The wave data stored in the wave memory 19 is read out by the tone generator 18.

The first volume controller 20 alters the amplitude of the digital tone signal output from the tone generator 18 in accordance with the first coefficient V1 supplied from the CPU 10. Specifically, this first volume controller 20 comprises the aforementioned first multiplier 200 and a first register 201. The first register 201 serves to temporarily store the first coefficient V1 supplied from the CPU 10. The first multiplier 200 multiplies the digital tone signal supplied from the tone generator 18 by the first coefficient V1 stored in the first register 201. Through this multiplication, the amplitude of the digital tone signal output from the tone generator 18 is altered in accordance with the first coefficient V1. The output of the first multiplier 200 is supplied to the first D/A converter 22.

The second volume controller 21 alters the amplitude of the digital tone signal output from the tone generator 18 in accordance with the second coefficient V2 supplied from the CPU 10. Specifically, this second volume controller 21 comprises the aforementioned second multiplier 210 and a second register 211. The second register 211 serves to temporarily store the second coefficient V2 supplied from the CPU 10. The second multiplier 210 multiplies the digital tone signal supplied from the tone generator 18 by the second coefficient V2 stored in the second register 211. Through this multiplication, the amplitude of the digital tone signal output from the tone generator 18 is altered in accordance with the second coefficient V2. The output of the second multiplier 210 is supplied to the second D/A converter 23.

The first D/A converter 22 and second D/A converter 23 respectively convert the digital tone signals from the first volume controller 20 and second volume controller 21 to analog tone signals. The analog tone signal output from the first D/A converter 22 is supplied to the low-pass filter (LPF) 24, and the analog tone signal output from the second D/A converter 23 is output as the second tone signal OUT2 outside of the tone signal generating apparatus.

The low-pass filter 24 extracts low-frequency components from the analog tone signal supplied from the first D/A converter 22, and outputs the resultant tone signal. The tone signal with low-frequency components extracted by the low-pass filter 24 is output as the first tone signal OUT1 outside of the tone signal generating apparatus.

As described above, a part of the function of the CPU 10 serves a part of the function of the tone signal generating apparatus 1. The CPU 10 serving as the tone signal generating apparatus 1 includes the velocity detecting portion 50 (referred to the velocity detector 50), a first amplitude controlling portion 51 (hereinafter, referred to the first amplitude controller 51) and a second amplitude controlling portion 52 (hereinafter, referred to the second amplitude controller 52).

The velocity detector 50 refers to key data supplied from the key scanning circuit 16 and stored in the RAM 12 to compute the time period from the point at which the first key switch of one key is set on to the point at which the second switch is set on, and outputs the time as a velocity value. This velocity value is supplied to the envelope generator 41 in the tone generator 18 and is used as one element to produce an envelope signal. This velocity value is also supplied to the first amplitude controller 51 and the second amplitude controller 52 to be used to produce the first coefficient V1 and second coefficient V2.

The first amplitude controller 51 refers to the aforementioned first table to obtain the first coefficient V1 according to the velocity value supplied from the velocity detector 50, and sets the coefficient V1 to the first register 201. The second amplitude controller 52 refers to the aforementioned second table to obtain the second coefficient V2 according to the velocity value supplied from the velocity detector 50, and sets the coefficient V2 to the first register 211.

The operation of an electronic musical instrument to which the tone signal generating apparatus according to the first embodiment with the above-described structure is applied, will now be described in detail with reference to the flowcharts given in FIGS. 3 through 5. The following description will discuss only those portions which relate to the present invention.

Figure 3:
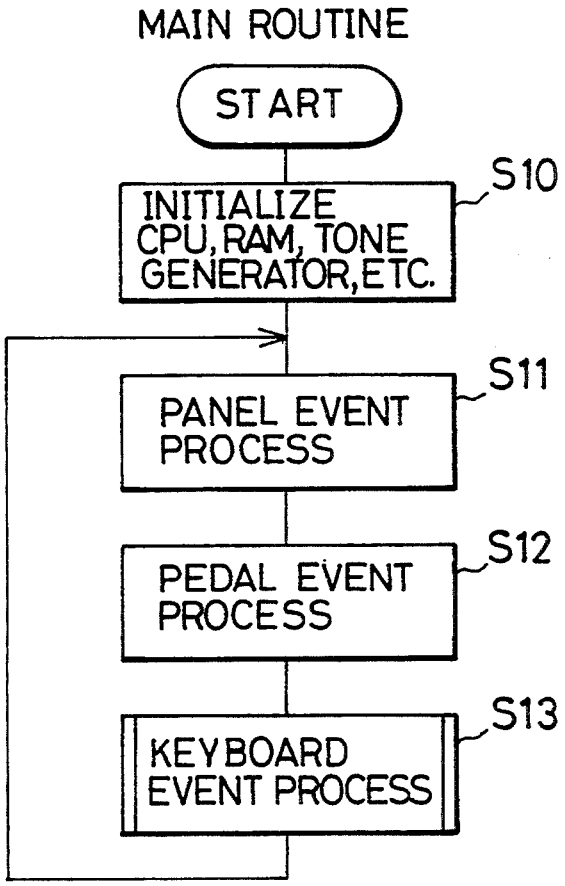
FIG. 3 is a flowchart (main routine) illustrating the operation of the present invention.

FIG. 3 presents a flowchart showing the main routine of the tone signal generating apparatus according to the first embodiment of the present invention. The main routine is invoked when power is provided. First, the CPU 10, RAM 12, tone generator 18, etc. are initialized (step S10). In this initialization, the registers and flags in the CPU 10 are cleared, initial values are set to various types of buffers, registers, flags, etc. defined in the RAM 12, and an initial value is set to the tone generator 18 to suppress the generation of undesired tones.

Next, the panel event process is performed (step S11). In this panel event process, first, the control panel 13 is scanned to obtain panel data indicating the set status of each switch (hereinafter called "new panel data"). Then, the new panel data is compared with panel data previously read and already stored in the RAM 12 (hereinafter called "old panel data") to check if there is a different bit between the new panel data and the old panel data.

If there is an unmatched bit, it is known that a panel event has occurred. And a panel event map with the bit corresponding to the status-changed switch being set on is prepared. Various processes associated with the switch operations of the control panel 13 are executed by referring this panel event map.

For example, when it is determined that an event of the timbre change switch has occurred, the timbre changing process is carried out. In this timbre changing process, a timbre number corresponding to the timbre specified by the timbre change switch is produced and stored in a predetermined region in the RAM 12. The stored timbre number is converted to a wave address and is supplied to the tone generator 18 to be used to specify the wave data that is to be read out from the wave memory 19, at the time a key depression process is performed in a keyboard event processing routine (which will be described later).

When the panel event map is referred and it is determined that an event of the effect switch has occurred, a process of providing a predetermined sound effect is executed. When it is determined that an event of another switch has occurred, a process associated with the event-occurred switch is performed. The events of those switches are not directly concerned with the present invention, and a detailed description will not be provided.

Then, the pedal event process is executed (step S12). In this pedal event process, first, the pedals 14 are scanned to obtain the pedal data indicating the depression status of each pedal such as a damper pedal, a soft pedal or a sostenuto pedal (hereinafter called "new pedal data").

Then, the new pedal data is compared with pedal data previously read and already stored in the RAM 12 (hereinafter called "old pedal data") to check if there is a different bit between the new pedal data and the old pedal data. If there is an unmatched bit, it is known that a pedal event has occurred. And a pedal event map with the bit corresponding to the status-changed pedal being set on is prepared. Referring to this pedal event map, a process associated with the event-occurred pedal, i.e., the damper pedal process, soft pedal process or sostenuto pedal process, is executed.

The damper pedal process includes a damper 0N process which is performed when the ON event of the damper pedal occurs, and a damper OFF process which is performed when the OFF event of the damper pedal occurs. The damper ON process stores data indicating the damper pedal being on in the RAM 12. This stored data will be referred to at the time of generating musical tone signals. If data indicating the damper pedal being on is present in the RAM 12, the envelope signal is processed to make the release time longer. The damper OFF process stops generating the musical tone, which is kept generated even after the associated key has been released due to the damper pedal being set on, in synchronism with the event of setting the damper pedal off.

The soft pedal process controls the envelope to reduce the tone, for example, and change the timbre to soften the tone at the time the soft pedal in the pedals 14 is depressed. The sostenuto pedal process performs the same process as the above-described damper pedal process only on that tone which is associated with the operated key at the time the sostenuto pedal in the pedals 14 is operated.

When this pedal event process is completed, the keyboard event process will be carried out next (step S13). In this keyboard event process, first, the keyboard 17 is scanned by the key scanning circuit 16 to obtain key data indicating the depression status of each key (hereinafter called "new key data").

Then, the new key data is compared with key data previously read and already stored in the RAM 12 (hereinafter called "old key data") to check if there is a different bit between the new key data and the old key data. If there is an unmatched bit, it is known that a key event has occurred. And a key event map with the bit corresponding to the status-changed key being set on is prepared. It is to be noted that even when MIDI data supplied via the MIDI interface circuit 15 is data indicating key ON or key OFF, a key event map is prepared similarly.

Referring to this key event map, the key number of the event-occurred key and touch data (velocity value) indicating the speed of key depression are prepared. The key number and the touch data are subjected to predetermined conversion and are then supplied to the tone generator 18 to be used in the key depression process/key release process of that event-occurred key. The details of this keyboard event process will be given later.

When the keyboard event process is completed, the flow returns to step S11 and the above-described sequence of processes will be repeated. When the control panel 13, the keyboard 17 or any pedal 14 is operated while the sequence of steps S11 to S13 is repeated, an event associated with the operation occurs and a process associated with the event is performed, thereby allowing the electronic musical instrument to perform its various functions.

Now, a MIDI interrupt process will be described referring to the flowchart in FIG. 4. This MIDI interrupt occurs in asynchronously with the operation of the CPU 10. That is, when MIDI data is supplied from an external device, the MIDI interface circuit 15 activates an interrupt request line (not shown) to request an interrupt to the CPU 10.

Figure 4:
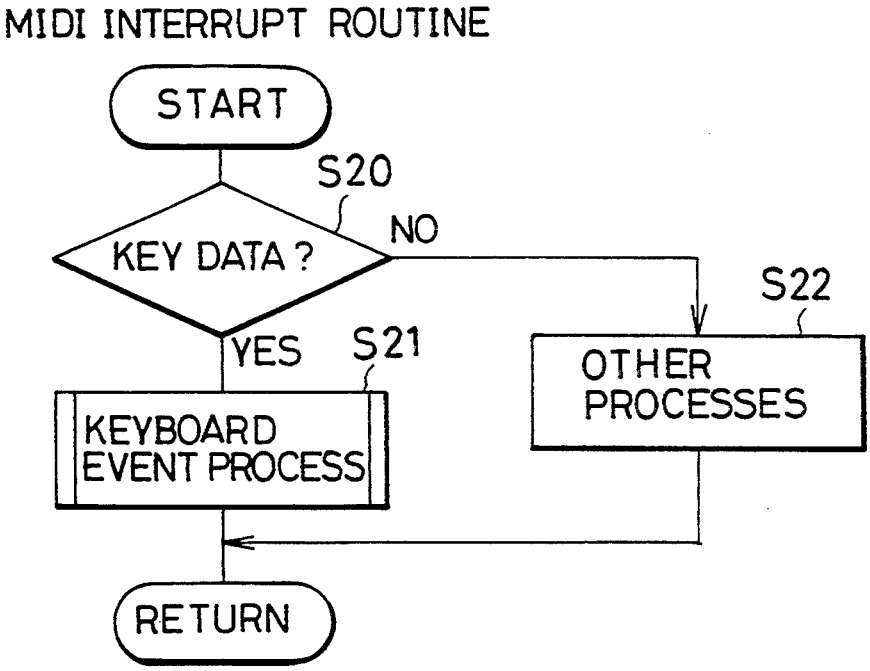
FIG. 4 is a flowchart (MIDI interrupt routine) illustrating the operation of the present invention.
Figure 5:
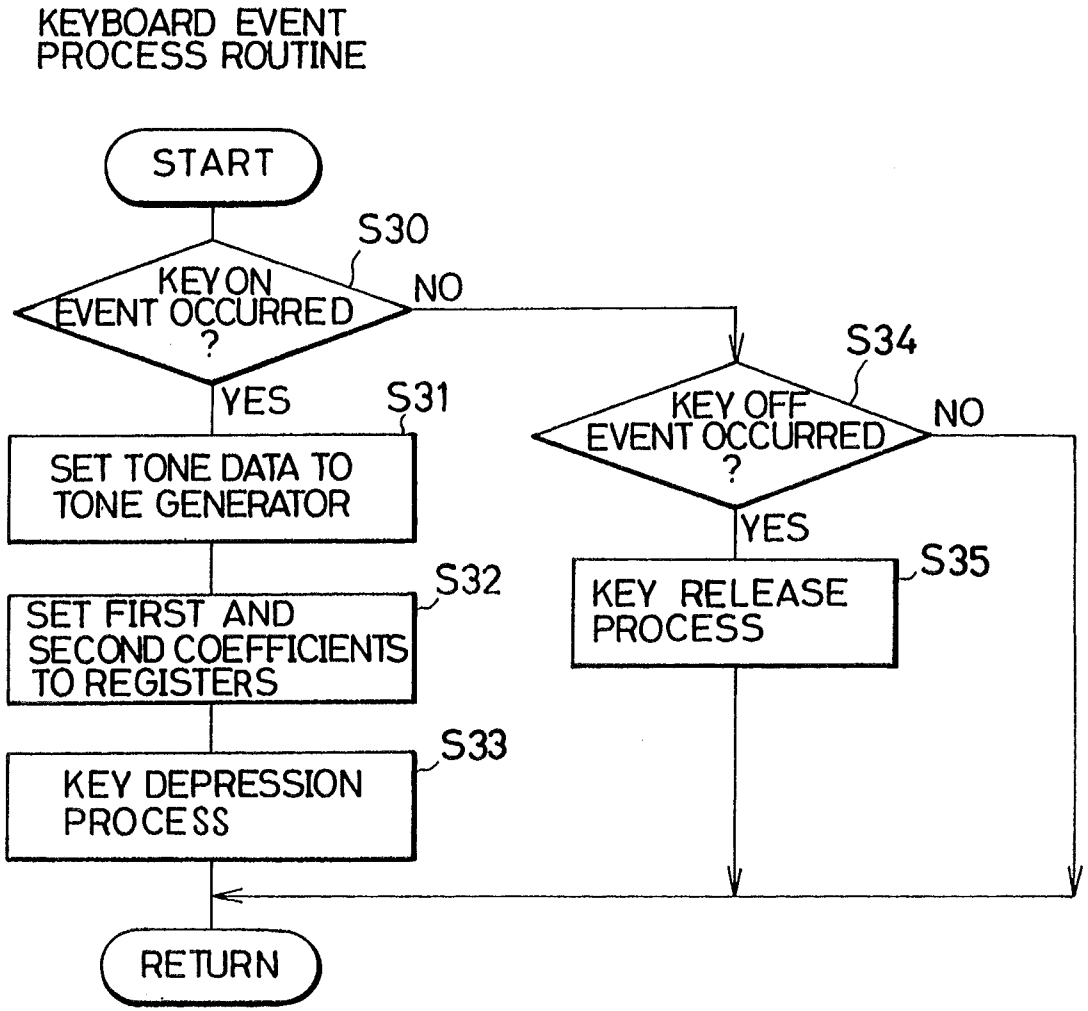
FIG. 5 is a flowchart (keyboard event processing routine) illustrating the operation of the present invention.

When the CPU 10 receives this interrupt request, the MIDI interrupt routine shown in FIG. 4 is invoked. In the MIDI interrupt routine, it is first checked if the received MIDI data is key data (step S20). Here, the "key data" is a note ON message or note OFF message of MIDI. When it is determined that the MIDI data is key data, the keyboard event process is performed (step S21). This keyboard event process is the same as the one executed in step S13 in the main routine, and the details of that process will be given later. When the keyboard event process is completed, the flow returns to the main routine from this MIDI interrupt routine.

When it is not determined in step S20 that the MIDI data is key data, any one of "other processes" which is associated with the received MIDI data is carried out (step S22). The "other processes" include timbre changing process and volume changing process, for example. When the associated one of the "other processes" is completed, the flow returns to the main routine from the MIDI interrupt routine.

The keyboard event process will now be described in detail referring to the flowchart shown in FIG. 5.

In the keyboard event process, as described above, a key event map is prepared first, and it is then determined whether or not the process for each key should be performed, by referring to the key event map.

In the keyboard event process, first, it is checked if there is a key ON event (step S30). The occurrence or non-occurrence of the key ON event is determined by checking if the bit in new key data which corresponds to a bit set on in the key event map is also set on. When it is determined that a key ON event has occurred, tone data is set in the tone generator 18 (step S31). More specifically, one oscillator in the tone generator 18 is selected by a predetermined algorithm, and tone data is supplied to the selected oscillator from the CPU 10. As the selection of a desired oscillator or the assigning of a tone-generating channel is a known scheme, it will not be discussed below.

The tone data set in the selected oscillator includes a wave address, frequency data and envelope data. The wave address is prepared in association with the timbre number of the timbre specified by the timbre changing switch (not shown) of the control panel 13 or the timbre number included in a program change message received at the MIDI interface circuit 15. The wave address is used as an address at the time the wave data is read out from the wave memory 19.

The aforementioned frequency data is prepared in association with the key number of an operated key on the keyboard 17 or the key number included in the note ON message or note OFF message received at the MIDI interface circuit 15. This frequency data is used to specify the speed at which the wave data is read out from the wave memory 19.

The aforementioned envelope data is prepared by adding the pedal data to the above-described touch data (velocity value). This envelope data is used to determine the shape of the envelope that should be added to the tone waveform. For instance, when the pedal data indicates that the damper pedal is depressed, envelope data which takes a long period of time for tone off is prepared, and, when otherwise, envelope data which takes a relatively short period of time for tone off is prepared. The function of the damper pedal is accomplished in this manner.

The wave address and the frequency data are supplied to the wave reading circuit 40 in the tone generator 18, and the envelope data are supplied to the envelope generator 41 in the tone generator 18.

When setting the tone data in the tone generator 18 is completed, a process of setting the first coefficient and second coefficient respectively to the first register 201 and second register 211 is performed (step S32). As a result, in the key depression process described below, the digital tone signal produced by the tone generator 18 is multiplied by the first coefficient and second coefficient respectively set in the first register 201 and second register 211, thereby altering the amplitude of the digital tone signal.

When the setting of the tone data in the tone generator 18 is completed, the key depression process is carried out next (step S33). The key depression process activates the associated oscillator to start generating a digital tone signal based on the tone data set in the tone generator 18 in the aforementioned step S31.

Although the operation of the tone generator 18 to produce a digital tone signal has already been explained, its brief description will be given again. Each oscillator of the tone generator 18 reads out the wave data from the location in the wave memory 19 which is specified by the wave address, at the speed corresponding to the frequency data. At the same time, an envelope signal corresponding to the timbre data and the touch data is produced from the envelope generator 41. The wave data and the envelope signal are multiplied by each other by the multiplier 42, thus yielding an envelope-added digital tone signal.

The digital tone signal produced from the tone generator 18 is supplied to the first multiplier 200 and the second multiplier 201. The first multiplier 200 multiplies the digital tone signal received from the tone generator 18 by the first coefficient V1 set in the first register 201, and sends out the result to the first D/A converter 22. The second multiplier 210 likewise multiplies the digital tone signal received from the tone generator 18 by the second coefficient V2 set in the second register 211, and sends out the result to the second D/A converter 23. Accordingly, the tone signals OUT1 and OUT2 output from the tone signal generating apparatus 1 become analog tone signals whose amplitudes have been altered in accordance with the key depression speed.

The tone signal converted to an analog signal by the first D/A converter 22 is supplied via the low-pass filter 24 and the amplifier 26 to the loudspeaker 27 to be sounded. The tone signal converted to an analog signal by the second D/A converter 23 is supplied via-the amplifier 28 to the loudspeaker 29 to be sounded. The function of altering the timbre in accordance with the key depression speed is accomplished by simultaneously generating musical tones to be mixed.

It is determined in the aforementioned step S30 that no key ON event has occurred, it is then checked if there is a key OFF event (step S34). The occurrence or non-occurrence of the key OFF event is determined by checking if the bit in new key data which corresponds to a bit set on in the key event map is set off. When it is determined that no key OFF event has occurred, the flow returns to the main routine from the keyboard event processing routine without performing any process.

When it is determined that a key OFF event has occurred, on the other hand, the key release process is performed (step S35). This key release process stops tone generation associated with the key on the keyboard 17 which has been released, when the damper pedal is not pressed. This process is accomplished by increasing the release time of the envelope of the musical tone in a tone-ON state. With the damper pedal pressed, the process of stopping the tone generation will not be performed immediately. Even when the key is released with the damper pedal depressed, therefore, a musical tone undergone the aforementioned timbre change is kept sounded, thus accomplishing the function of the damper pedal.

As described above, according to the first embodiment, the wave data containing frequency components within the full band is prepared in advance in the wave memory 19. When key ON/OFF data is given, the wave data corresponding to the key ON/OFF data is read out from the wave memory 19 in the tone generator 18, to generate an associated digital tone signal. In parallel to the generation of the digital tone signal, the velocity value is obtained on the basis of the key ON/-OFF data, the first coefficient V1 for changing the amplitude of the tone signal is obtained in accordance with the detected velocity value, and the aforementioned tone signal is multiplied by the produced first coefficient V1.

The digital tone signal with the amplitude changed by this multiplication is converted by the first D/A converter 22 to an analog tone signal, which is then put through the low-pass filter 24, yielding the first digital tone signal. If the first coefficient V1 is produced in accordance with a predetermined function, e.g., the first characteristic in FIG. 9, the first tone signal contains low-frequency components and its amplitude decreases as the velocity value increases.

The second coefficient V2 for changing the amplitude of the tone signal is obtained also in accordance with the detected velocity value, and the tone signal produced from the tone generator 18 is multiplied by this second coefficient V2. The resultant digital tone signal with the amplitude changed by this multiplication is treated as the second digital tone signal. If the second coefficient V2 is produced in accordance with a predetermined function, e.g., the second characteristic in FIG. 9, the second tone signal contains frequency components within the full band and its amplitude increases as the velocity value increases.

When the thus produced first and second tone signals are sounded through loudspeakers, the musical tone containing frequency components within the full band and the musical tone containing frequency components within a specific band, in the sounded state are mixed in accordance with the velocity value. This can ensure a timbre change in accordance with the key touch.

Second Embodiment

Figure 6:
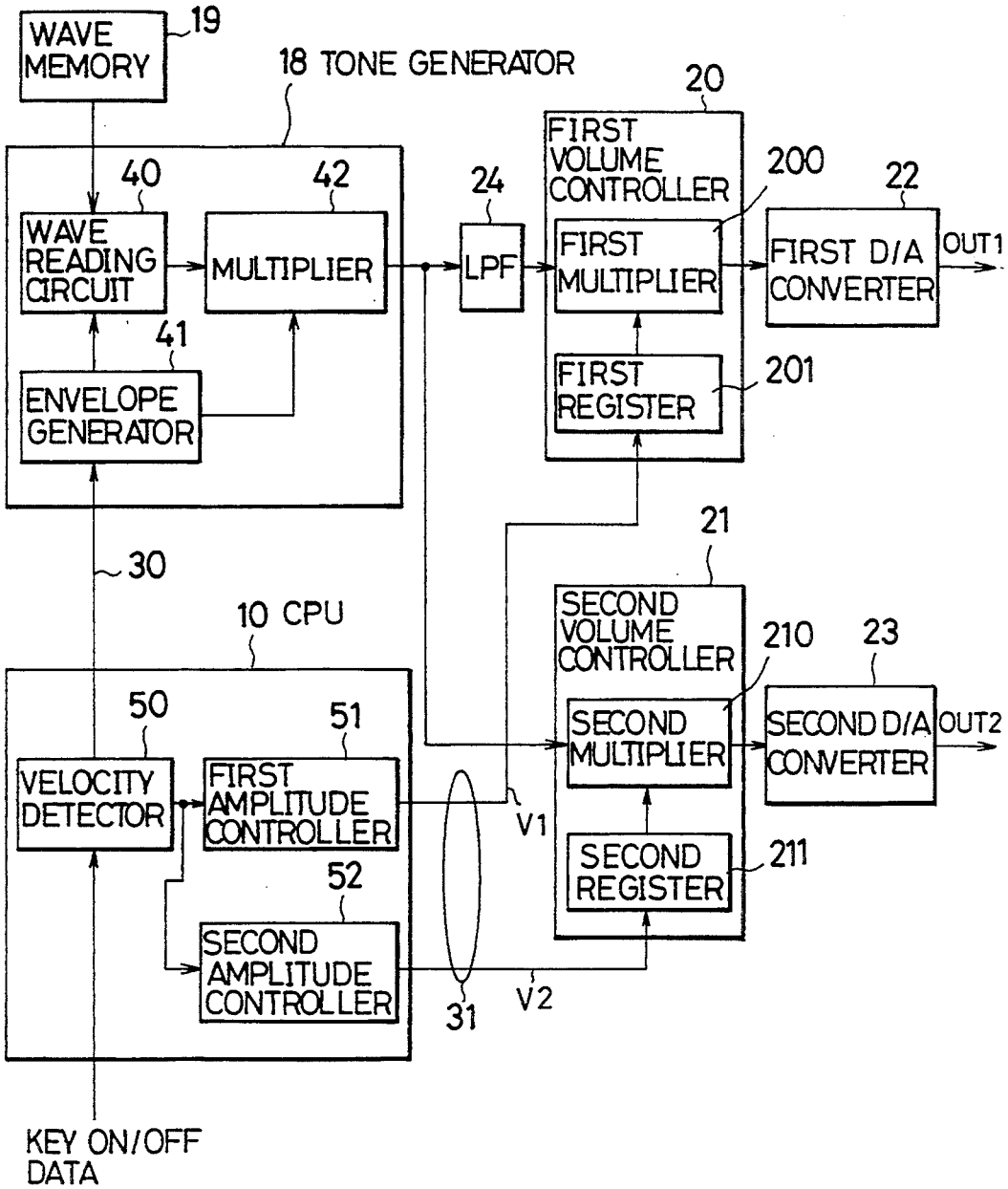
FIG. 6 is a block diagram showing the structure of a tone signal generating apparatus according to a second embodiment of the present invention.

FIG. 6 is a block diagram showing the detailed structure of the tone signal generating apparatus according to the second embodiment. This tone signal generating apparatus of the second embodiment comprises a tone generator 18, a wave memory 19, a first volume controller 20, a second volume controller 21, a first D/A converter 22, a second D/A converter 23, a low-pass filter (LPF) 24 and a part of the CPU 10, as per the first embodiment. The second embodiment however differs from the first embodiment in that the low-pass filter 24 is located between the tone generator 18 and the first volume controller 20, not on the output side of the first D/A converter 22.

In the above-describe first embodiment, the tone signal converted to an analog signal by the first D/A converter 22 is put through the low-pass filter 24, so that the low-pass filter 24 is constituted of an analog filter. In the second embodiment, however, the low-pass filter 24 is located between the tone generator 18 and the first volume controller 20, so that the filter 24 filters the digital tone signal output from the tone generator 18. Thus, the low-pass filter 24 is constituted of a digital filter.

As the operation of the tone signal generating apparatus according to the second embodiment is the same as that of the above-described first embodiment except that the digital tone signal having low-frequency components extracted in the low-pass filter 24 is multiplied by the first coefficient V1 in the first volume controller 20, the description will not be given.

According to the second embodiment, since the low-pass filter 24 is constituted of a digital filter, the function of this filter 24 can be accomplished by the processing of the CPU 10. In this case, there is an advantage such that hardware to constitute the filter is unnecessary, thus allowing the tone signal generating apparatus to be designed simpler and at a lower cost.

Although the low-pass filter 24 is located between the tone generator 18 and the first volume controller 20 in FIG. 6, this filter 24 may be provided between the first volume controller 20 and the first D/A converter 22. This modification will also provide the same function and advantages as provided by the second embodiment.

Third Embodiment

Figure 7:
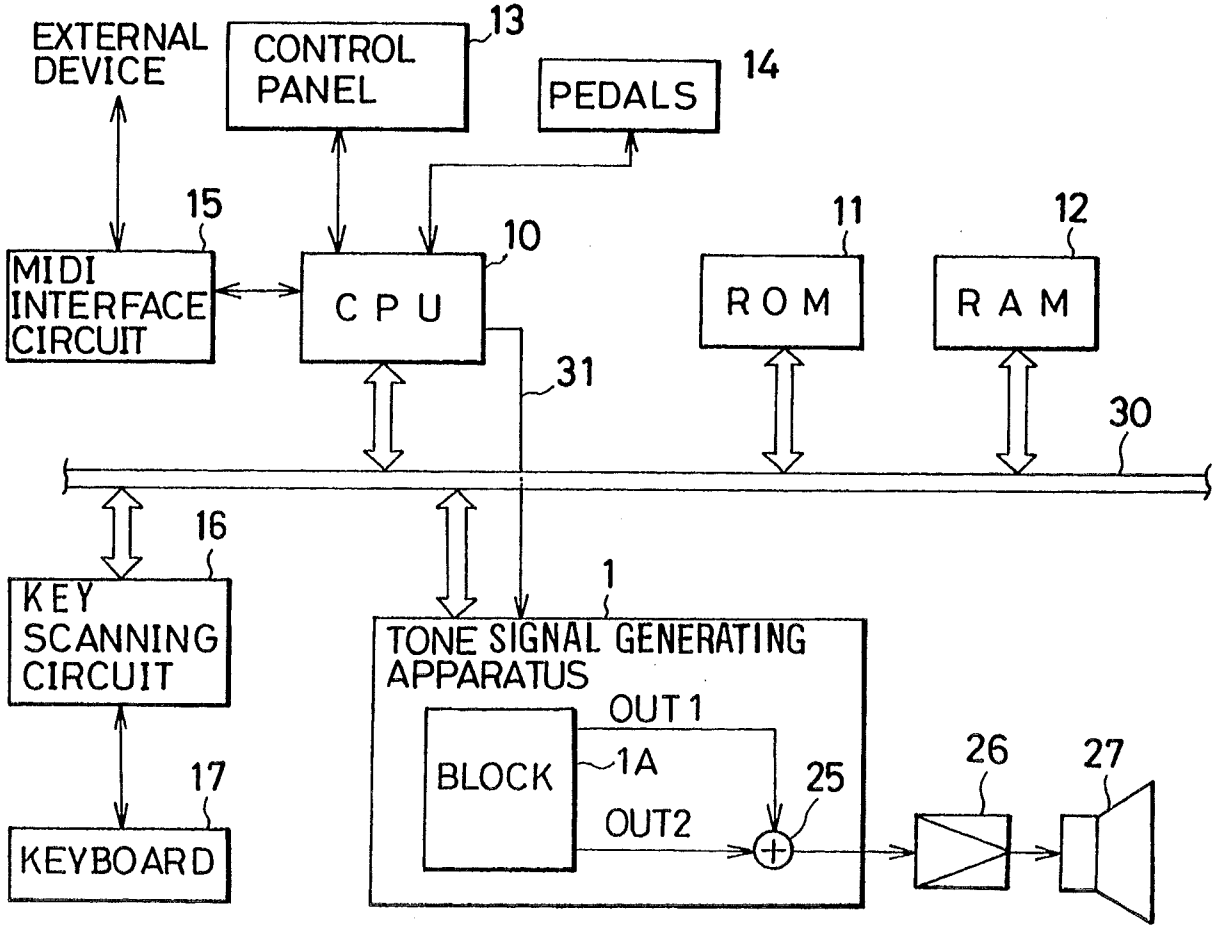
FIG. 7 is a block diagram illustrating the structure of an electronic musical instrument to which a tone signal generating apparatus according to a third embodiment of the present invention is adapted.
Figure 8:
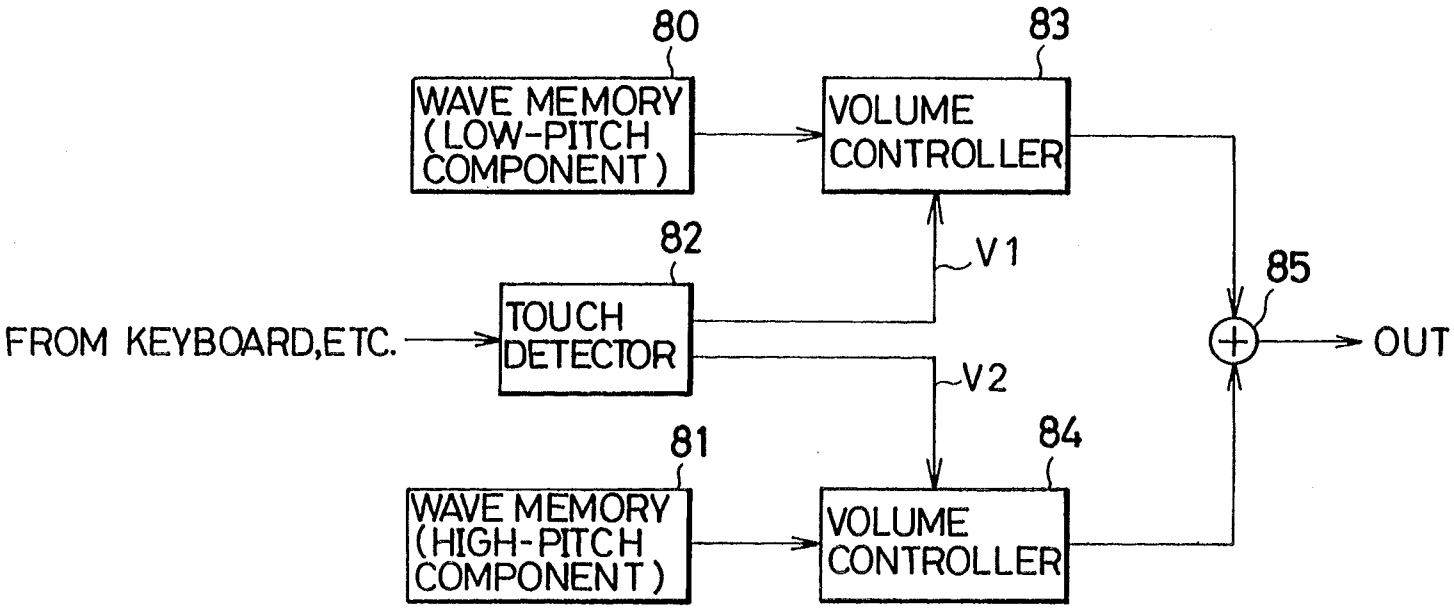
FIG. 8 is a block diagram showing the structure of a conventional tone signal generating apparatus.

Although tone signals of two systems, namely, the tone signal OUT1 containing low-frequency components within a specific band and the tone signal OUT2 containing frequency components within the full band are output in the tone signal generating apparatuses according to the first and second embodiments, an adder 25 for adding the tone signal OUT1 and the tone signal OUT2 together may be further provided in the tone signal generating apparatus as shown in FIG. 7. In this case, the block denoted by reference numeral "1A" corresponds to the tone signal generating apparatuses of the first and second embodiments.

To apply the tone signal generating apparatus of the third embodiment to an electronic musical instrument, the output of the adder 25 is amplified by the amplifier 26 and the amplified tone signal is sounded through the loudspeaker 27.

According to the tone signal generating apparatus with this structure, since the tone signal OUT1 containing low-frequency components within a specific band and the tone signal OUT2 containing frequency components within the full band are mixed and output, this apparatus simply requires an amplifier and a loudspeaker for one system. If this tone signal generating apparatus is applied to an electronic musical instrument, therefore, the instrument will become simpler.

Although the tone signal OUT2 containing frequency components within the full band and the tone signal OUT1 containing low-frequency components within a specific band are mixed at the ratio according to the key touch to accomplish a timbre change according to the key touch in the first to third embodiments, the low-pass filter 24 may be replaced with a high-pass filter or a band-pass filter. This modification will also provide the same functions and advantages as provided by those embodiments.

Although only the tone signal of one system (first tone signal) is filtered to yield a tone signal within a specific band, and the tone signal of the other system (second tone signal) is mixed as a tone signal containing frequency components within the full band to the filtered tone signal in the first to third embodiments, the tone signals of both systems may be filtered and then mixed. For example, the tone signal of one system may be filtered by a low-pass filter to yield a tone signal containing low-frequency components and the tone signal of the other system may be filtered by a high-pass filter to yield a tone signal containing high-frequency components. Those resultant tone signals may then be mixed and sounded, thereby ensuring the generation of a musical tone which has the timbre change emphasized more.

Figure 9:
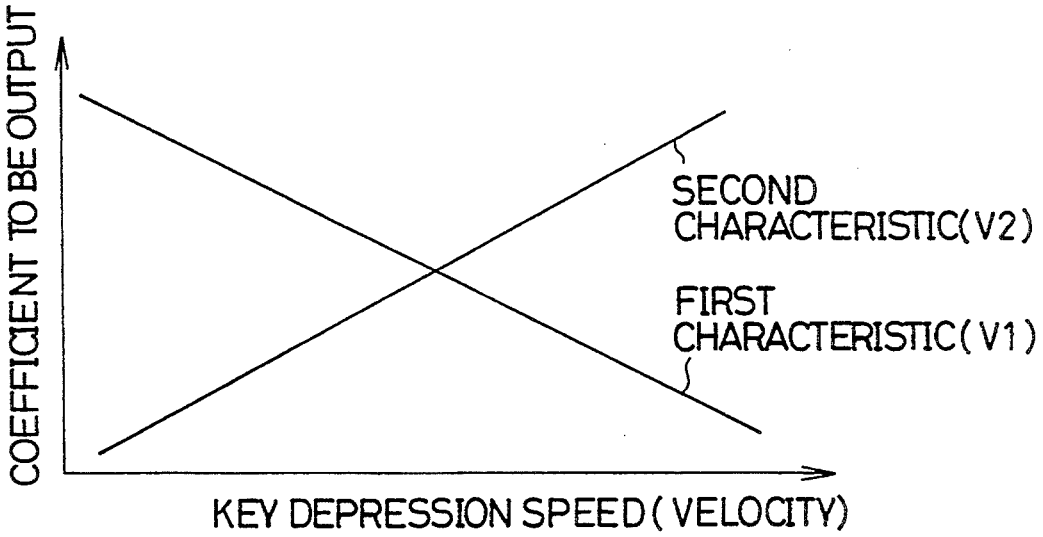
FIG. 9 is a diagram for explaining the operations of the conventional tone signal generating apparatus and the tone signal generating apparatus embodying the present invention.

Although linear functions as shown in FIG. 9 are used as examples of the functions to generate the first coefficient V1 and second coefficient V2, which define the mixing ratio of two tone signals in the first to third embodiments, the present invention is not limited to this particular type, and various other functions which will contribute to changing the timbre may also be used.

As described in detail above, according to the present invention, as only wave data containing frequency components within the full band is stored in the wave memory and no separate hardware is necessary to read out this wave data, it is possible to provide an inexpensive tone signal generating apparatus which will ensure a timbre change according to the key touch, with fewer wave memories and a smaller amount of hardware.

What is claimed is:

1. A tone signal generating apparatus comprising:

memory means for storing wave data containing frequency components within a full band;

a tone generator for reading out said wave data from said memory means in accordance with key ON/-OFF data and generating a signal based on said wave data;

velocity value generating means for generating a velocity value based on the key ON/OFF data;

first coefficient processing means for obtaining a first coefficient according to said velocity value generated by said velocity value generating means;

first operation means for combining said first coefficient obtained by said first coefficient processing means and said signal generated by said tone generator and to produce a tone signal;

filtering means for extracting frequency components within a specific band from said tone signal output from said first operation means to produce a first tone signal, and outputting said first tone signal;

second coefficient processing means for obtaining a second coefficient according to said velocity value generated by said velocity value generating means; and second operation means for combining said second coefficient obtained by said second coefficient processing means and said signal generated by said tone generator to produce a second tone signal, and outputting said second tone signal.

2. The tone signal generating apparatus according to claim 1, wherein a value of said first coefficient obtained by said coefficient processing means decreases as said velocity value increases, and a value of said second coefficient obtained by said second coefficient processing means increases as said velocity value increases.

3. The tone signal generating apparatus according to claim 1, wherein said first operation means is a multiplier.

4. The tone signal generating apparatus according to claim 1, wherein said second operation means is a multiplier.

5. The tone signal generating apparatus according to claim 1, wherein said filtering means is a low-pass filter.

6. The tone signal generating apparatus according to claim 1, further comprising mixing means for mixing said first tone signal output from said filtering means with said second tone signal output from said second operation means and outputting a resultant signal.

7. The tone signal generating apparatus according to claim 6, wherein said mixing means is an adder.

8. A tone signal generating apparatus comprising:

memory means for storing wave data containing frequency components within a full band;

a tone generator for reading out said wave data from said memory means in accordance with key ON/-OFF data and generating a signal based on said wave data;

filtering means for extracting frequency components within a specific band from said signal generated from said tone generator to produce a tone signal, and outputting said tone signal;

velocity value generating means for generating a velocity value based on the key ON/OFF data;

first coefficient processing means for obtaining a first coefficient according to said velocity value generated by said velocity value generating means;

first operation means for combining said first coefficient obtained by said first coefficient processing means and said tone signal output from said filtering means to produce a first tone signal, and outputting said first tone signal;

second coefficient processing means for obtaining a second coefficient according to said velocity value generated by said velocity value generating means; and second operation means for combining said second coefficient obtained by said second coefficient processing means and said signal generated by said tone generator to produce a second tone signal, and outputting said second tone signal.

9. The tone signal generating apparatus according to claim 8, wherein a value of said first coefficient obtained by said first coefficient processing means decreases as said velocity value increases, and a value of said second coefficient obtained by said second coefficient processing means increases as said velocity value increases.

10. The tone signal generating apparatus according to claim 8, wherein said first operation means is a multiplier.

11. The tone signal generating apparatus according to claim 8, wherein said second operation means is a multiplier.

12. The tone signal generating apparatus according to claim 8, wherein said filtering means is a low-pass filter.

13. The tone signal generating apparatus according to claim 8, further comprising mixing means for mixing said first tone signal output from said first operation means with said second tone signal output from said second operation means and outputting a resultant signal.

14. The tone signal generating apparatus according to claim 13, wherein said mixing means is an adder.

* * * * *